US007601103B2

(12) United States Patent
Chen et al.

(10) Patent No.: US 7,601,103 B2
(45) Date of Patent: Oct. 13, 2009

(54) SWIMMING EXERCISE DEVICE

(76) Inventors: Her-Chun Chen, P.O. Box 44-2049, Taipei (TW) 10668; Her-Fa Chen, P.O. Box 44-2049, Taipei (TW) 10668

( * ) Notice: Subject to any disclaimer, the term of this patent is extended or adjusted under 35 U.S.C. 154(b) by 667 days.

(21) Appl. No.: 11/385,812

(22) Filed: Mar. 22, 2006

(65) Prior Publication Data

US 2007/0225128 A1 Sep. 27, 2007

(51) Int. Cl.
*A63B 69/10* (2006.01)

(52) U.S. Cl. ..... 482/56; 434/254

(58) Field of Classification Search ..... 482/55, 482/56, 140, 142; 441/55; 434/254, 255; 602/33

See application file for complete search history.

(56) References Cited

U.S. PATENT DOCUMENTS 3,791,646 A * 2/1974 Marchignoni ..... 482/56
4,422,634 A * 12/1983 Hopkins ..... 482/8
4,674,740 A * 6/1987 Iams et al. ..... 482/56
5,158,513 A * 10/1992 Reeves ..... 482/56
5,282,748 A * 2/1994 Little ..... 434/254
5,376,060 A * 12/1994 Murray ..... 482/56
5,393,280 A * 2/1995 Haviv ..... 482/56
5,540,591 A * 7/1996 Doane ..... 434/254
5,628,632 A * 5/1997 Doane ..... 434/254
5,860,899 A * 1/1999 Rassman ..... 482/142
6,764,431 B2 * 7/2004 Yoss ..... 482/56

* cited by examiner

*Primary Examiner*—Loan H Thanh
*Assistant Examiner*—Tam Nguyen
(74) *Attorney, Agent, or Firm*—Charles E. Baxley

(57) ABSTRACT

This invention relates to a "swimming exercise device", which includes a device body, a pendulous device, two arm stroke gears and two elastic devices. The body includes a front portion and a rear portion; one end of the front portion is coupled to one end of the rear portion; a space is formed between the front portion and the rear portion. The pendulous device is disposed in the space, one end thereof is pivoted on the front portion and the other end thereof is pivoted on the rear portion. The arm stroke gears are respectively on the top of both sides of the front portion of the body and the elastic devices are respectively pivoted on the upper edge of the rear portion of the body.

11 Claims, 6 Drawing Sheets

SWIMMING EXERCISE DEVICE

BACKGROUND OF THE INVENTION (1) Field of the Invention

This invention relates to a swimming exercise device, in particular, an exercise device that enables a user to simulate types of swimming strokes anywhere without entering into water, so that the user is able to achieve the objective of fitness swimming.

(2) Description of the Prior Art

Generally, swimming is a good exercise to benefit the body and the whole person. With increasing swimming lovers, people have higher demands for water safety and quality.

Seeing that beginning learners easily have a great fear of water, or wrong strokes in the water resulting in poor learning effect, a device that enables a swimming learner to learn how to swim with correct strokes before getting into water would reduce the learning obstacle to a swimming learner.

In view of the foregoing, a swimming exercise device of the invention is hereafter disclosed to achieve the practicability effect in the industry.

SUMMARY OF THE INVENTION

The main objective of the invention is to provide a swimming exercise device, especially an exercise device for a swimming learner to simulate various strokes on the ground, so that a swimming learner is able to practice those strokes anytime and anywhere.

Another objective of the invention is to provide a swimming exercise device with a variety of strokes for a swimming learner to select for learning improvement.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
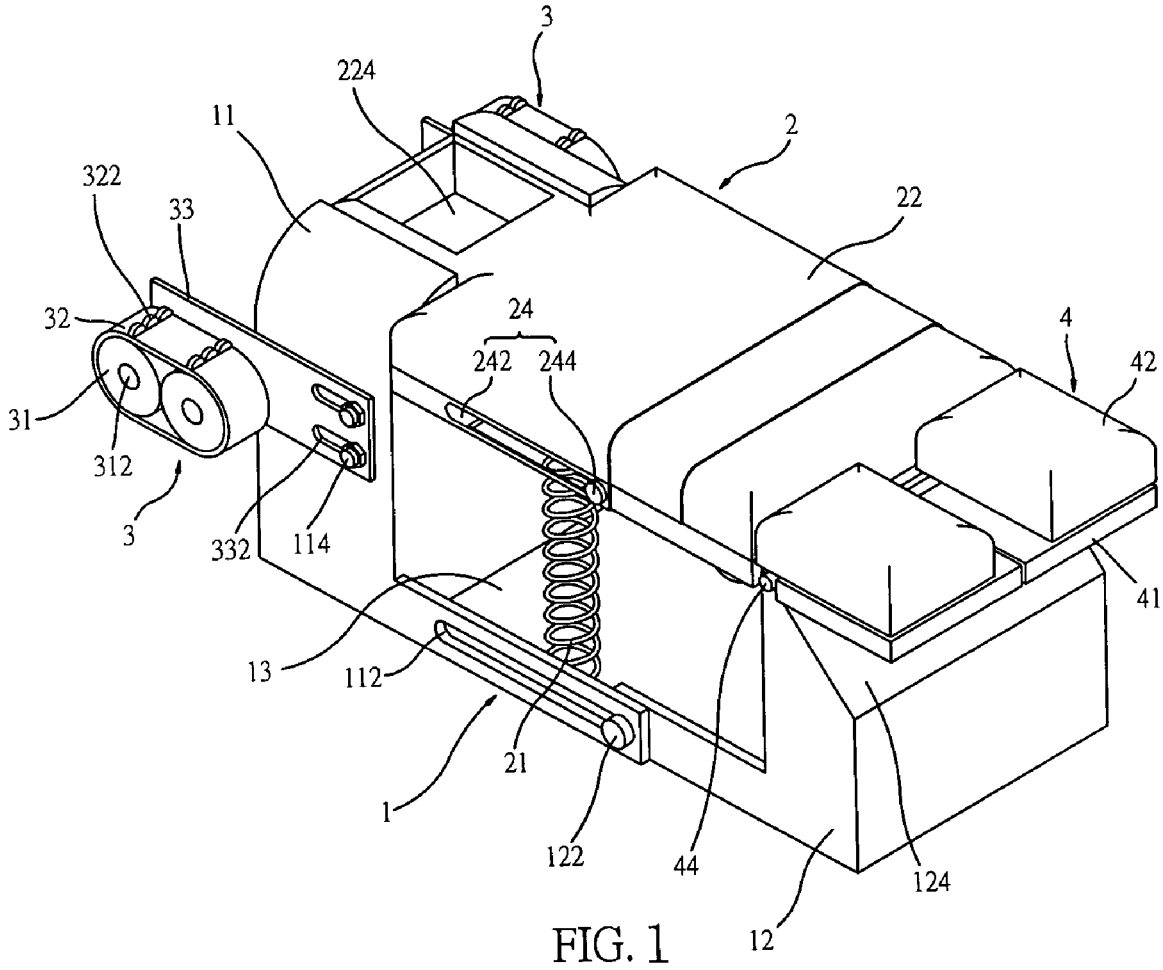
FIG. 1 is a three-dimensional diagram showing the assembly of a swimming exercise device of the invention.
Figure 2:
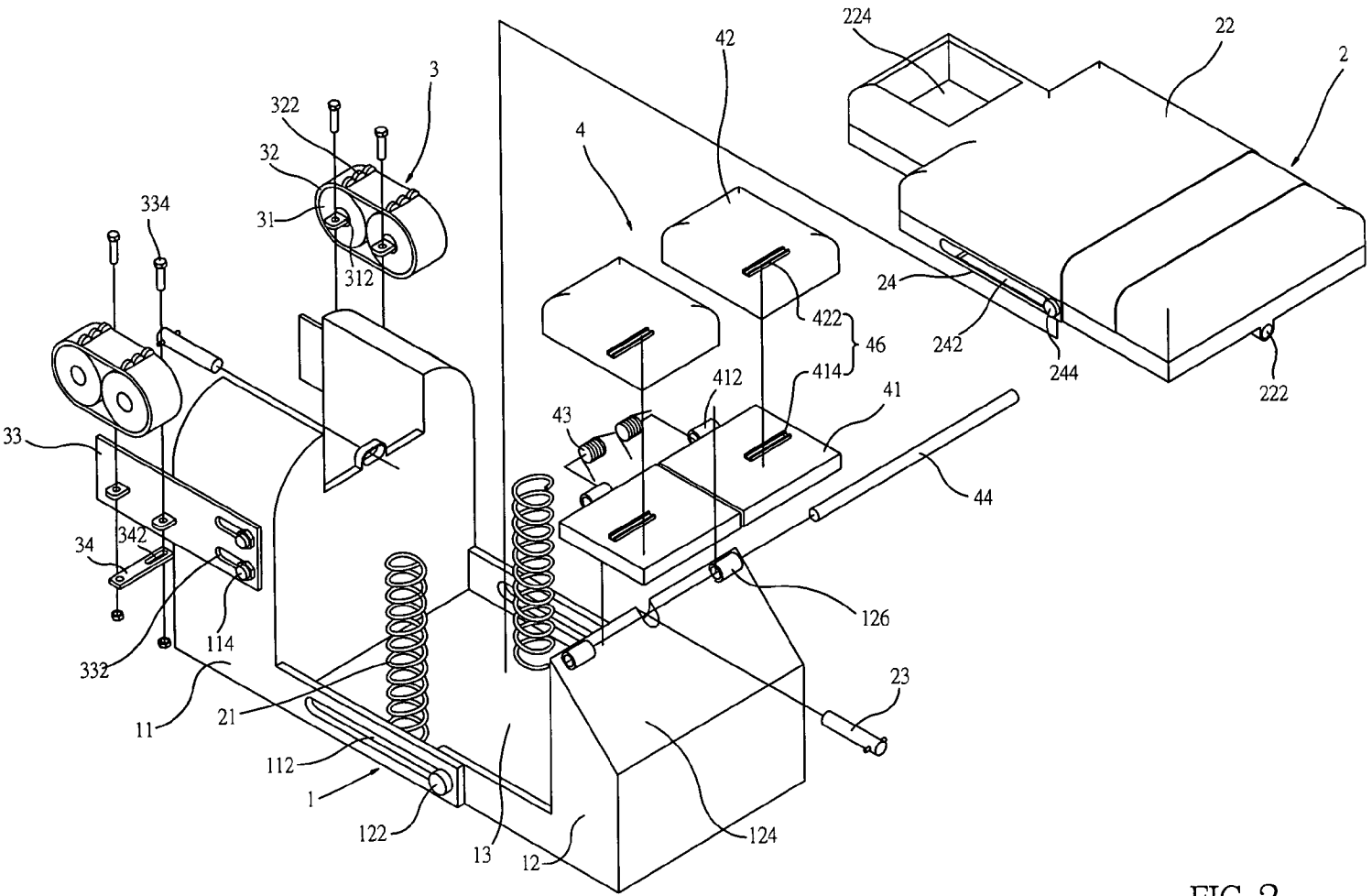
FIG. 2 is a three-dimensional exploded diagram of the invention.

With reference to FIGS. 1 and 2, a swimming exercise device of the invention comprises a device body 1, a pendulous device 2, two arm stroke gears 3 and two elastic devices 4.

The body 1 comprises a front portion 11 and a rear portion 12; the front portion 11 and the rear portion 12 are connected by a slot 112 and a raised piece 122, thereby the front portion 11 and the rear portion 12 are able to be flexibly linked and elastically activated. A space 13 is formed between the front portion 11 and the rear portion 12.

Figure 3A:
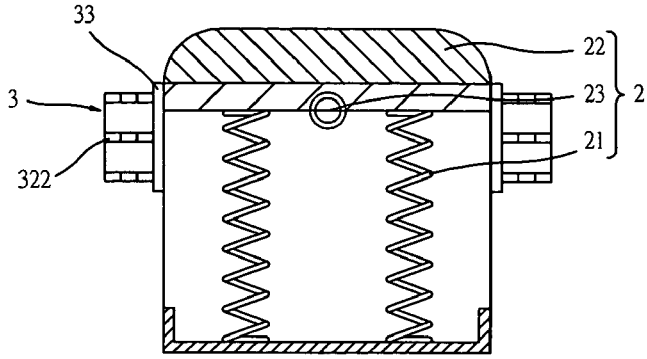
FIG. 3A is a cross-sectional view showing the swimming exercise device of the invention.

Said pendulous device 2 is disposed in the space 13, one end thereof is pivoted on the front portion 11 and the other end thereof is pivoted on the rear portion 12 for a human body to lie down and swing arms. Said pendulous device 2 comprises two springs 21 respectively disposed on two sides in the space 13; a flat-top 22 is disposed in-between the front portion 11 and the rear portion 12, having two adjustable mechanisms 24 disposed on two correspondent sides. The adjustable mechanisms 24 each consists of a groove 242 and a raised piece 244, the combination of the groove 242 and the raised piece 244 enables the flat-top 22 to flexibly activate. In addition, an opening 224 is formed on one end of the flat-top 22 enabling a human to lay his/her face thereon. The opening 224 is placed on the tip of the front portion 11. The correspondent sides on the bottom of the flat-top 22 are respectively coupled to the springs 21 on the top thereof (as shown in FIG. 3A). The springs 21 are able to be compressed springs, drag springs, or gas springs, etc. Moreover, two pivot holes 222 and two shafts 23 are respectively disposed on another two correspondent sides of the flat-top 22, the shafts 23 respectively pierce through said pivot holes 222, thereby enabling the two correspondent sides of the flat-top 22 to be pivoted on the front portion 11 and the rear portion 12.

Figure 3B:
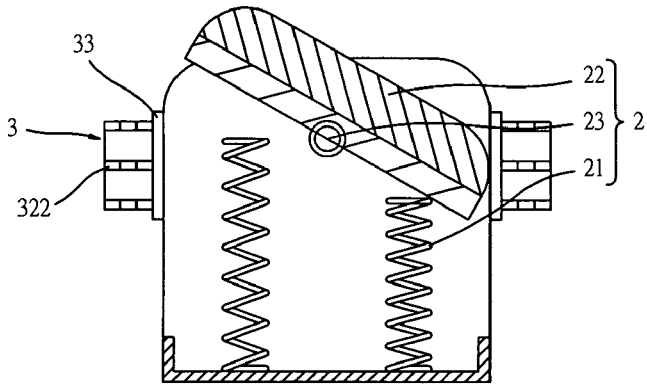
FIG. 3B is a cross-sectional view showing the movement of the swimming exercise device of the invention.
Figure 3C:
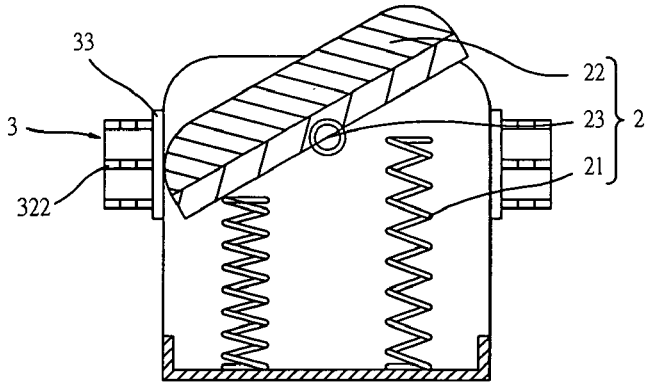
FIG. 3C is another cross-sectional view showing the movement of the swimming exercise device of the invention.

The invention further provides a preferred embodiment as shown in FIGS. 3B and 3C that the springs 21 disposed on the bottom of the two correspondent sides of the flat-top 22 are compressed springs to give the flat-top 22 a buffer strength, so that the flat-top 22 is able to swing to the left or right on the device body 1.

Figure 5:
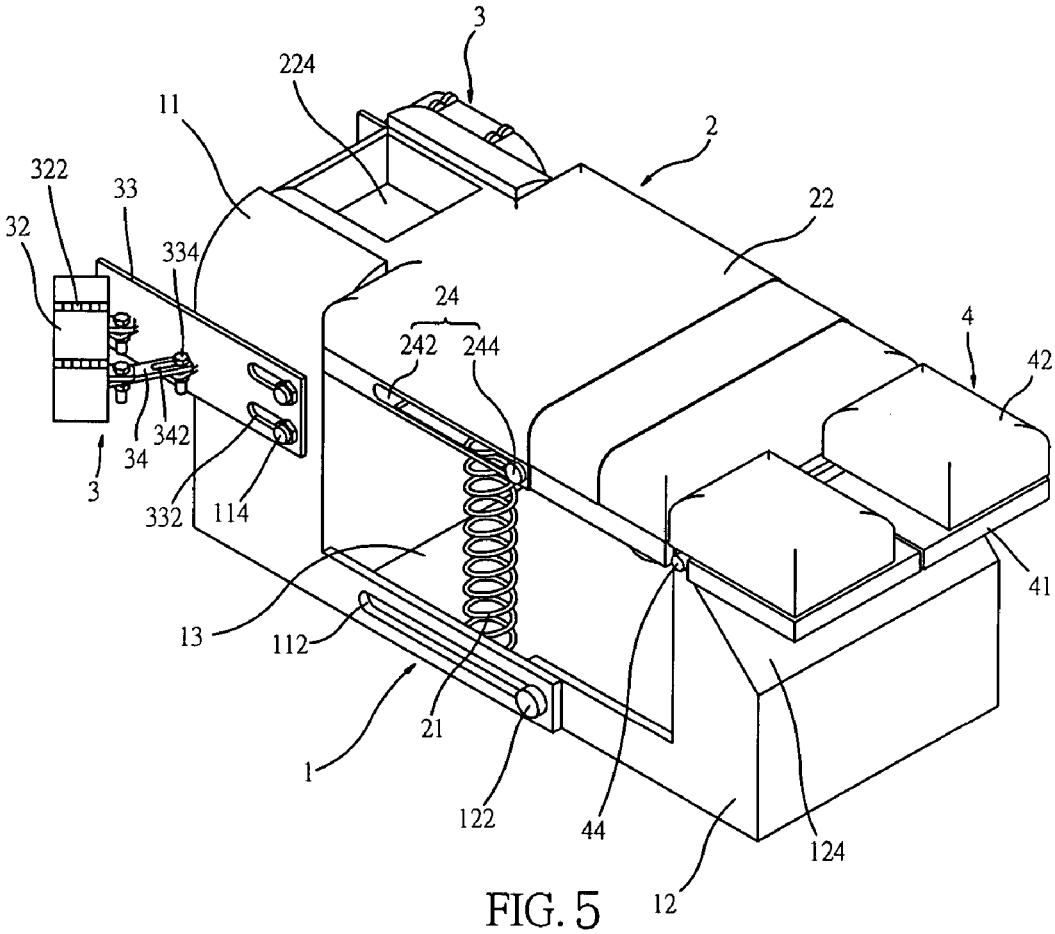
FIG. 5 is another three-dimensional view showing the assembly of the swimming exercise device of the invention.

In addition, the arm stroke gears 3 are respectively on the top of both sides of the front portion 11 of the body 1 for a user to simulate swimming strokes by swinging his/her arms. Said arm stroke gears 3 each comprises two rollers 31, each of which comprises a shaft 312 and a driving belt 32. The driving belt 32 is placed over the exterior of the roller 31. Pluralities of coupling portions are set on the surface of the driving belt 32 for a user's fingers to hold and swing his/her arms. Two coupling members 33 each has one side thereof connects one side of the front portion 11 of the body 1 on the upper edge by coupling a groove 332 and a raised piece 114 together, thereby the other side of the coupling member 33 is pivoted on one side of each of the shafts 312. One end of each of two connecting rods 34 and each of the coupling members 33 are coupled together for sliding through the combination of a slide groove 342 and a raised piece 334. The other end of the connecting rod 34 is pivoted on one end of the shaft of another roller, thereby enabling said connecting rod 34 and said coupling member 33 to be elastically activated (as shown in FIG. 5).

Said elastic devices 4 are respectively pivoted on the upper edge of the rear portion of the body 1 for a user's legs to swing to up or down. Said elastic devices 4 each comprises a base plate 41, which has one side thereof set a first pin-joint portion 412. Said first pin-joint portion 412 is pivoted on the upper edge of the exterior of the rear portion 12 of the body 1, wherein the exterior of the rear portion 12 is an inclined plane 124, having the top thereof set a second pin-joint portion 126. Two leg cushions 42 each has the bottom thereof coupled to the upper surface of the base plate 41 by a sliding mechanism 46, which is consisted of a sliding piece 422 and a slide rail 414. A spring is disposed on one side of the first pin-joint portion 412. A shaft 44 pierces through the second pin-joint portion 126, the first pin-joint portion 412 and said spring 43, wherein the spring is a torsion spring.

Figure 6:
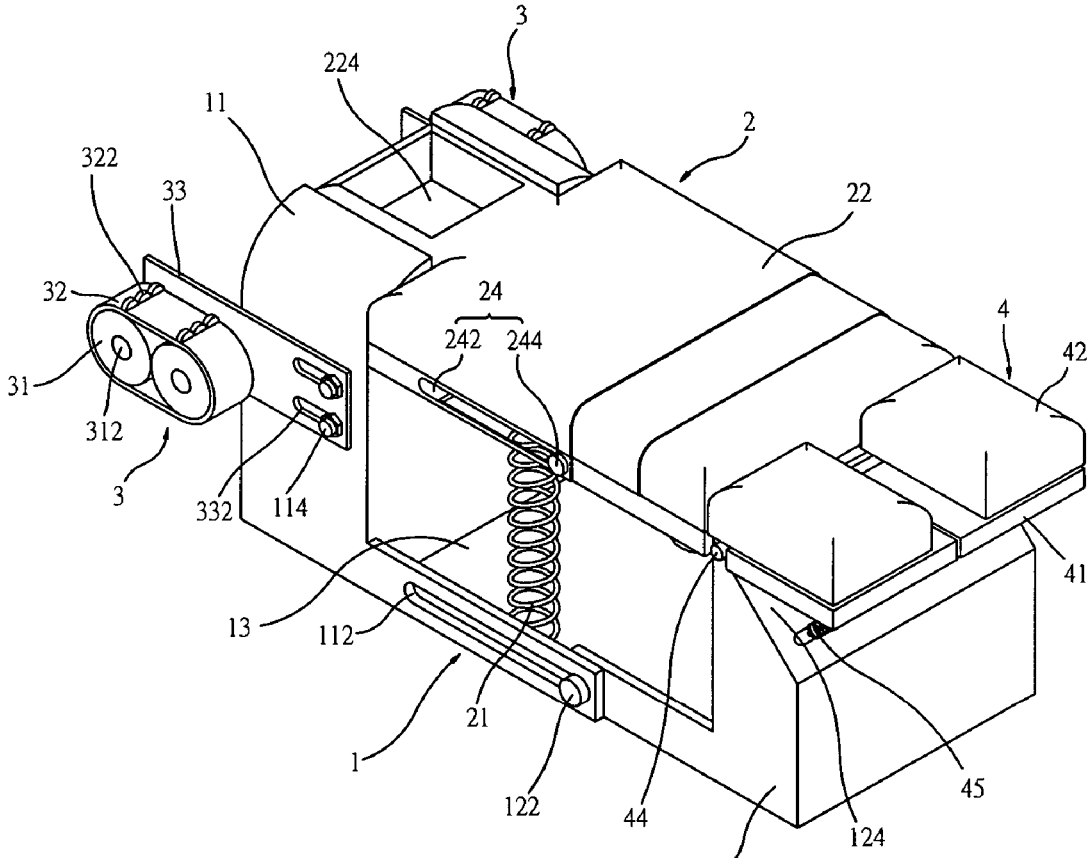
FIG. 6 is another three-dimensional view showing the assembly of the swimming exercise device of the invention.

With reference to FIG. 6, a spring 45 on said elastic device 4 is disposed between the exterior surface of the base plate 41 and the rear portion 12 of the body 1. The spring 45 is a compressed component.

When a user lays his/her legs on the leg cushions 42, the user is able to easily practice either the leg kick actions of the freestyle swimming strokes up or down, or the leg actions of the breast swimming strokes. When the user practices the knee bent movements of the breast strokes, the leg cushions 42 are pressed downwards by the springs 43; when the user practices the kick and knee bent movements, the leg cushions 42 and the base plated 41 become sliding mechanism for the user's legs and feet to easily finish the kick and knee bent movements.

When a beginning learner or a sports lover applies the invention to practice various swimming strokes, the user lays his/her face in an opening 224 on the front portion 11 of the body 1, subsequently, the user's arms and legs respectively simulate various swimming strokes through said arm stroke gears 3 and said elastic devices 4, therefore, the invention enables a user to achieve the objective of practicing swimming strokes on the ground.

Figure 4:
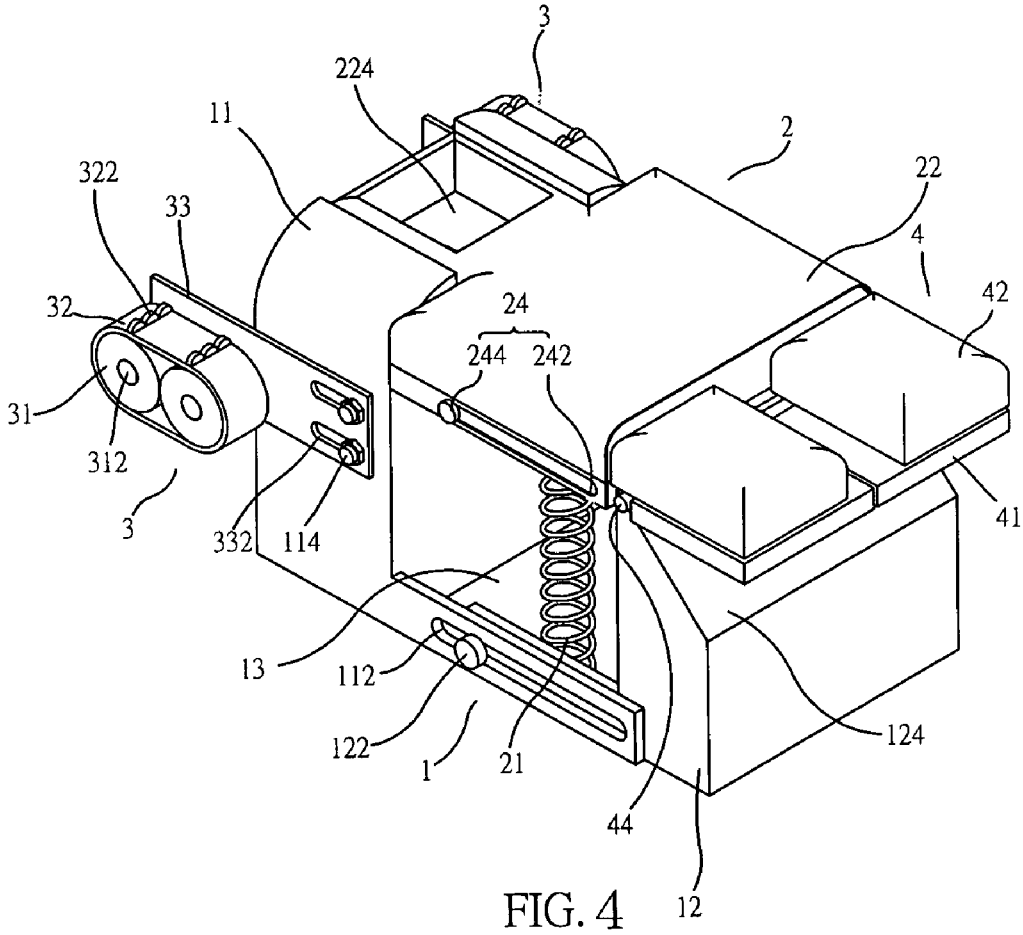
FIG. 4 is another three-dimensional view showing the assembly of the swimming exercise device of the invention.

With reference to FIG. 4, the position between the front portion 11 and the rear portion 12 on the body 1 is able to be an elastic member; the flat-top 22 of the pendulous device 2 enables a user to flexibly expand or contract the body; the flat-top 22 is able to be adjusted based on different human body sizes.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A swimming exercise device, comprising:

a device body, having a front portion and a rear portion; one side of the front portion is coupled to one side of the rear portion; a space is formed between the front portion and the rear portion;

a pendulous device, disposed in the space having one end thereof pivoted on the front portion and the other end thereof pivoted on the rear portion, the pendulous device including at least two springs, which are respectively disposed on two laterally corresponding sides in the space; a flat-top being disposed in-between the front portion and the rear portion; two lateral sides of the flat-top body on a bottom thereof being respectively coupled to the springs on the top thereof; two pivot holes and two shafts being respectively disposed on front and rear sides of the flat top body; the shafts respectively piercing through said pivot holes, thereby enabling the two laterally corresponding sides of the flat-top to be pivoted on the front portion and the rear portion such that the pendulous device rocks from side to side about the two pivot shafts;

two arm stroke gears, disposed respectively on the top of both lateral sides of the front portion of the device body; and two elastic devices, pivotally disposed respectively, side by side, on the upper edge of the rear portion of the device body.

2. The swimming exercise device of claim 1, wherein the front portion and the rear portion are coupled by a slot and a raised piece, thereby the front portion and the rear portion are able to be flexibly linked.

3. The swimming exercise device of claim 1, wherein the flat-top body forms an opening on one end suitable for a human face to lay thereon; the opening is disposed on the tip of the front portion.

4. The swimming exercise device of claim 1, wherein the flat-top body has adjustable mechanisms disposed on two laterally corresponding sides thereof, enabling the flat-top to be flexed.

5. The swimming exercise device of claim 4, wherein the adjustable mechanisms each is consisted of a groove and a raised piece.

6. A swimming exercise device, comprising:

a device body, having a front portion and a rear portion; one side of the front portion is coupled to one side of the rear portion; a space is formed between the front portion and the rear portion;

a pendulous device, disposed in the space having one end thereof pivoted on the front portion and the other end thereof pivoted on the rear portion such that the pendulous device rocks from side to side about the two pivot shaft;

two arm stroke gears, disposed respectively on the top of both sides lateral sides of the front portion of the body;

two elastic devices, pivotally disposed respectively, side by side, on an upper edge of the rear portion of the device body, and the arm stroke gears each including at least two rollers and a drive belt, each roller comprises a shaft; the driving belt being placed over the exterior of the rollers; two coupling members each having one side thereof connected to one side of the front portion of the device body and the other side thereof being connected to one side of each of the shafts; one end of each of two connecting rods and each of the coupling members being coupled together for sliding through the combination of a slide groove and a raised piece; the other end of the connecting rod being pivoted on one end of the shaft of another roller, thereby enabling said connecting rod and said coupling member to be pivotable relative to each other.

7. The swimming exercise device of claim 6, wherein the driving belt has pluralities of coupling portions set on the surface thereof for a user's fingers to hold and swing his/her arms.

8. The swimming exercise device of claim 6, wherein the coupling members each have on side thereof that connects to one side of the front portion of the device body by coupling a groove and a raised piece together, thereby the coupling member and the front portion are able to be pivotally coupled together.

9. A swimming exercise device, comprising: a device body, having a front portion and a rear portion; one side of the front portion is coupled to one side of the rear portion; a space is formed between the front portion and the rear portion;

a pendulous device, disposed in the space having one end thereof pivotally supported on the front portion via a first shaft that is connected to the pendulous device and pierces through a pivot hole disposed on the front portion and an opposite and an thereof pivotally supported on the rear portion via second shaft that is connected to the pendulous device and pierces through a pivot hole disposed on the rear portion;

two arm stroke gears, disposed respectively on a top portion of both lateral sides of the front portion of the device body;

two elastic devices, respectively pivoted on the upper edge of the rear portion of the device body side by side, wherein the elastic devices each including a base plate, a pin joint portion disposed on one side of the base plate to be coupled to the upper edge of the exterior of the rear portion of the device body, a leg cushion having a bottom thereof coupled to the upper surface of a respective base plate via a sliding mechanism and a torsion spring coupled to a respective pin joint portion such that elastic device are coupled to the rear portion when the pin joint portion of each elastic device is lined up with a pair of pin joint portion on the upper edge of the exterior of the rear portion, the torsion springs are coupled to the pin joint portions and a shaft is inserted to pierce though all four of the pin joint portion.

10. A swimming exercise device, comprising:

a body, having a front portion and a rear portion; one side of the front portion is coupled to one side of the rear portion; a space is formed between the front portion and the rear portion;

a pendulous device, disposed in the space having one end thereof pivotally supported on the front portion via a first shaft that is connected to the pendulous device and pierces through a pivot hole disposed on the front portion and an opposite and thereof pivotally supported on the rear portion via a second shaft that is connected to the pendulous device and pierces through a pivot hole disposed on the rear portion;

two arm stroke gears, disposed respectively on a top portion of both lateral sides of the front portion of the device body; and two elastic devices, respectively pivoted on the upper edge of the rear portion of the device body side by side, wherein the elastic devices each including a base plate, a pin joint portion disposed on one side of the base plate to be coupled to the upper edge of the exterior of the rear portion of the device body, a leg cushion having a bottom thereof coupled to the upper surface of a respective base plate via a sliding mechanism and a compression spring disposed between each respective base plate and the exterior portion of the device body such that the elastic devices are coupled to the rear portion when the pin joint portion of each elastic device is lined up with a pair of pin joint portion on the upper edge of the exterior of rear portion and a shaft is inserted to pierce through all four of the pin joint portion.

11. The swimming exercise device of claim 9, wherein the sliding mechanism is consisted of a sliding piece and a slide rail.

* * * * *